US007721784B2

(12) United States Patent
Lehmann et al.

(10) Patent No.: US 7,721,784 B2
(45) Date of Patent: May 25, 2010

(54) ARTICLE OF JEWELRY AND METHOD OF MANUFACTURE

(76) Inventors: Todd Philip Lehmann, 1581 Emery Rd., East Aurora, NY (US) 14052; Malcolm Warren, 1228 Main Rd., Corfu, NY (US) 14036

( * ) Notice: Subject to any disclaimer, the term of this patent is extended or adjusted under 35 U.S.C. 154(b) by 29 days.

(21) Appl. No.: 11/865,682

(22) Filed: Oct. 1, 2007

(65) Prior Publication Data

US 2008/0236196 A1 Oct. 2, 2008

Related U.S. Application Data

(63) Continuation of application No. 11/324,932, filed on Jan. 4, 2006, now abandoned.

(60) Provisional application No. 60/641,792, filed on Jan. 6, 2005.

(51) Int. Cl.
*B22C 7/02* (2006.01)
*A44C 27/00* (2006.01)

(52) U.S. Cl. ..... 164/4.1; 164/45; 29/896.4

(58) Field of Classification Search ..... 164/34, 164/35, 520, 161, 45, 516, 4.1; 63/23; 29/896.4–896.43
See application file for complete search history.

(56) References Cited

U.S. PATENT DOCUMENTS

| | | | | |
|---|---|---|---|---|
| 4,518,288 | A * | 5/1985 | Cilindro | 409/219 |
| 4,966,460 | A * | 10/1990 | Kahley | 356/640 |
| 4,993,472 | A * | 2/1991 | Culver | 164/35 |
| 6,568,455 | B2 * | 5/2003 | Zieverink | 164/4.1 |
| 2005/0053275 | A1 * | 3/2005 | Stokes | 382/154 |

* cited by examiner

*Primary Examiner*—Jessica L. Ward
*Assistant Examiner*—Kevin E Yoon
(74) *Attorney, Agent, or Firm*—Robert D. Gunderman, Jr.; Patent Technologies, LLC

(57) ABSTRACT

A method and system for creating an article of jewelry that contains an anatomical image using a digital image of an anatomical body part such as a fingerprint, handprint, footprint, or the like to create a computer numeric controlled (CNC) software program that drives a machine for producing a wax model of the anatomical image. The wax model is used in a lost wax casting process to create a casting that is used in an article of jewelry. The present invention further provides an article of jewelry containing a novel bail assembly for attaching the article of jewelry to a chain or the like in an aesthetically pleasing manner that hides the attachment hole of the casting.

6 Claims, 15 Drawing Sheets

ARTICLE OF JEWELRY AND METHOD OF MANUFACTURE

CROSS-REFERENCE TO RELATED PATENT APPLICATIONS

This application is a continuation of applicants' co-pending patent application U.S. Ser. No. 11/324,932, filed on Jan. 4, 2006, which claims priority from U.S. provisional patent application U.S. Ser. No. 60/641,792, filed on Jan. 6, 2005. The entire disclosure of each of these patent applications is hereby incorporated by reference into this specification.

BACKGROUND OF THE INVENTION

1. Field of the Invention

This invention relates generally to articles of jewelry and methods of manufacturing articles of jewelry, and more particularly to an article of jewelry and a method of manufacturing an article of jewelry where the article of jewelry bears a reproduction of an anatomical part such as a fingerprint, a handprint, a footprint, or the like.

2. Description of the Related Art

The related art has disclosed various articles of jewelry that are ornamented with representations of fingerprints. Reference may be had, e.g., to U.S. Pat. No. 964,499 that discloses an impressionable mould used to create a casting of a fingerprint image. Other patents, for example, German Patent 2903728, U.S. Pat. No. 4,993,472, use hot wax to obtain the impression of a fingerprint for the purpose of creating a metal casting. U.S. Pat. No. 6,435,255 also uses wax to obtain the impression of a fingerprint, but improves upon the previous art by using a soft wax bonded to a hard wax substrate to obtain an impression of a fingerprint. U.S. Design Pat. No. 407,660 discloses an ornamental design for an article of jewelry with a textured surface in the form of a fingerprint.

The methods disclosed in the related art create a mirror image wax impression of a fingerprint that are capable of creating only a single casting per impression. Further, the methods previously disclosed in the related art subject an individual to direct contact with wax that may either create a residue on the individual's finger, or may expose the individual to hot wax and the discomfort associated with contacting hot wax. This discomfort is of particular concern to individuals such as young children or the elderly. In addition, often times it may be desirable to create an anatomical reproduction of a deceased family member's fingerprint, footprint, or handprint in an article of jewelry. The methods of the related art are limited in their ability to reproduce additional copies of a deceased individual's fingerprint or the like.

It is an object of the present invention to provide a method of manufacturing an article of jewelry that creates a true reproduction of an anatomical part such as a fingerprint, footprint, handprint, or the like. It is another object of the present invention to provide a method of manufacturing an article of jewelry that can produce multiple castings of an image of an anatomical part from a single impression of that anatomical part. It is a further object of the present invention to provide a method of manufacturing an article of jewelry that creates a true and accurate reproduction of a fingerprint that is of the same general shape as the fingerprint itself; e.g., an oval reproduction of said fingerprint. It is still another object of the present invention to provide an article of jewelry that contains a novel bail assembly for attaching the article of jewelry to a chain or the like in an aesthetically pleasing manner that hides an attachment hole of the article of jewelry.

BRIEF SUMMARY OF THE INVENTION

In accordance with the present invention, there is provided a method for creating an article of jewelry that contains an anatomical image, the method comprising the steps of taking a print of an anatomical part, creating a digital image file by taking a digital photograph of the print of an anatomical part, converting the digital image file to a computer numeric control machine language program, loading the computer numeric control machine language program on a computer numeric control machine, placing a sheet of machinable wax proximate the computer numeric control machine, executing the computer numeric control machine language program on the computer numeric control machine, cutting a wax model of an anatomical image in the sheet of machinable wax using the computer numeric control machine, removing the anatomical image from the sheet of machinable wax, creating a mould from the wax model of the anatomical image, using the mould to create a casting from the wax model of the anatomical image, and attaching a finding to the casting.

The foregoing paragraph has been provided by way of introduction, and is not intended to limit the scope of the following claims.

BRIEF DESCRIPTION OF THE DRAWINGS

The invention will be described by reference to the following drawings, in which like numerals refer to like elements, and in which.

Figure 1:
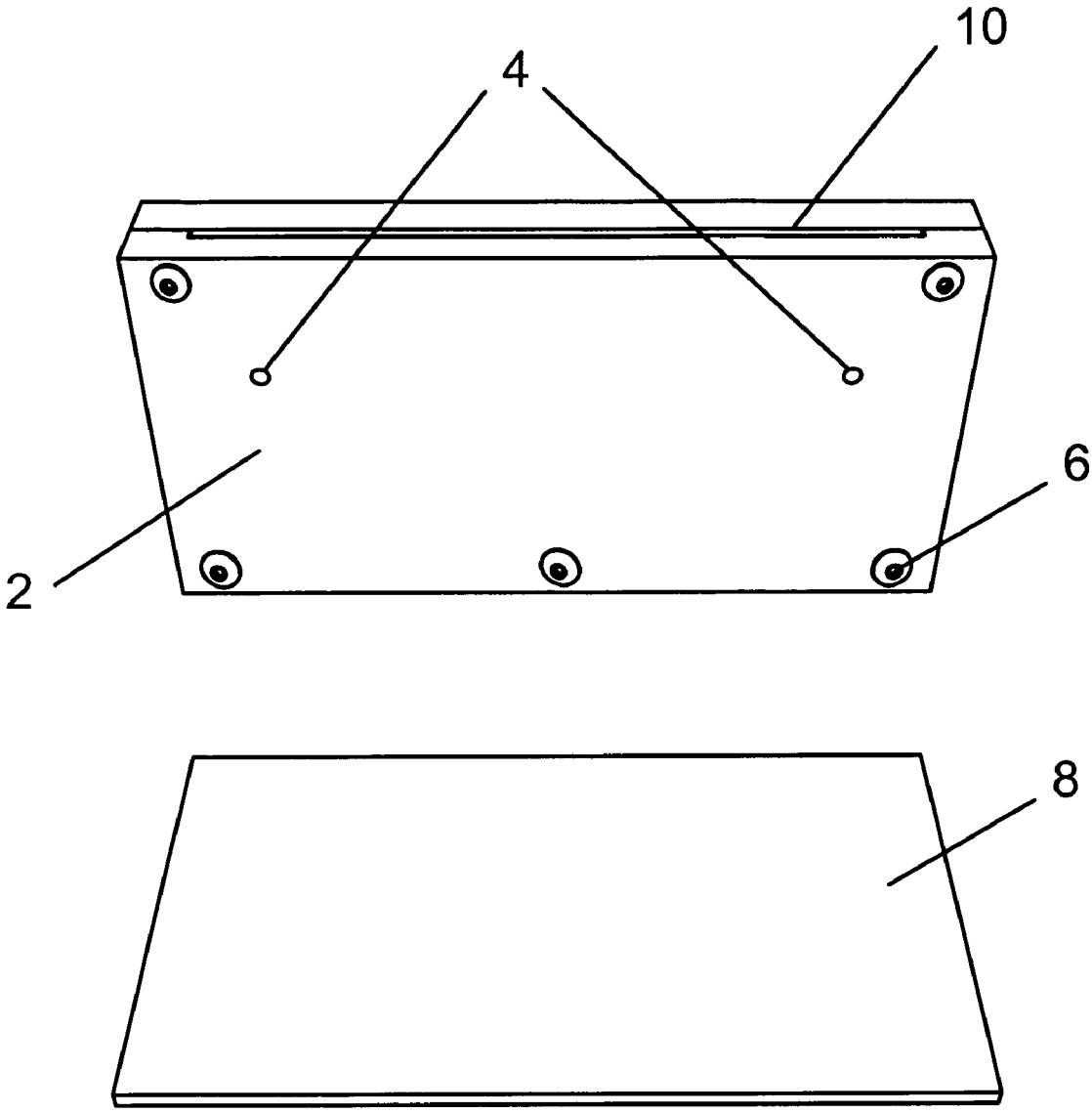
FIG. 1 is a perspective view of a wax jig and a sheet of machinable wax.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

For a general understanding of the present invention, reference is made to the drawings. In the drawings, like reference numerals have been used throughout to designate identical elements.

FIG. 1 is a perspective view of a wax jig and a sheet of machinable wax. Referring to FIG. 1, a wax jig 2 is shown. The wax jig 2 is made from a rigid material such as aluminum using standard machining and fabrication techniques. The wax jig 2 is used to prepare a sheet of machinable wax 8 for machining and cutting an image or a plurality of images of an anatomical part in the sheet of machinable wax 8. The wax jig 2 may be assembled from several flat elements and assembled using hardware such as bolts 6. The wax jig 2 contains a wax jig slot 10 to receive a sheet of machinable wax 8. The wax jig 2 may contain punch bit holes 4 that are used to retain a wax punch (not shown) that is used to cut alignment holes (not shown) in the sheet of machinable wax 8. The purpose of the alignment holes, as will be further described in this specification, is to align and prevent motion of the sheet of machinable wax 8 while it is undergoing machining and cutting operations.

Figure 2:
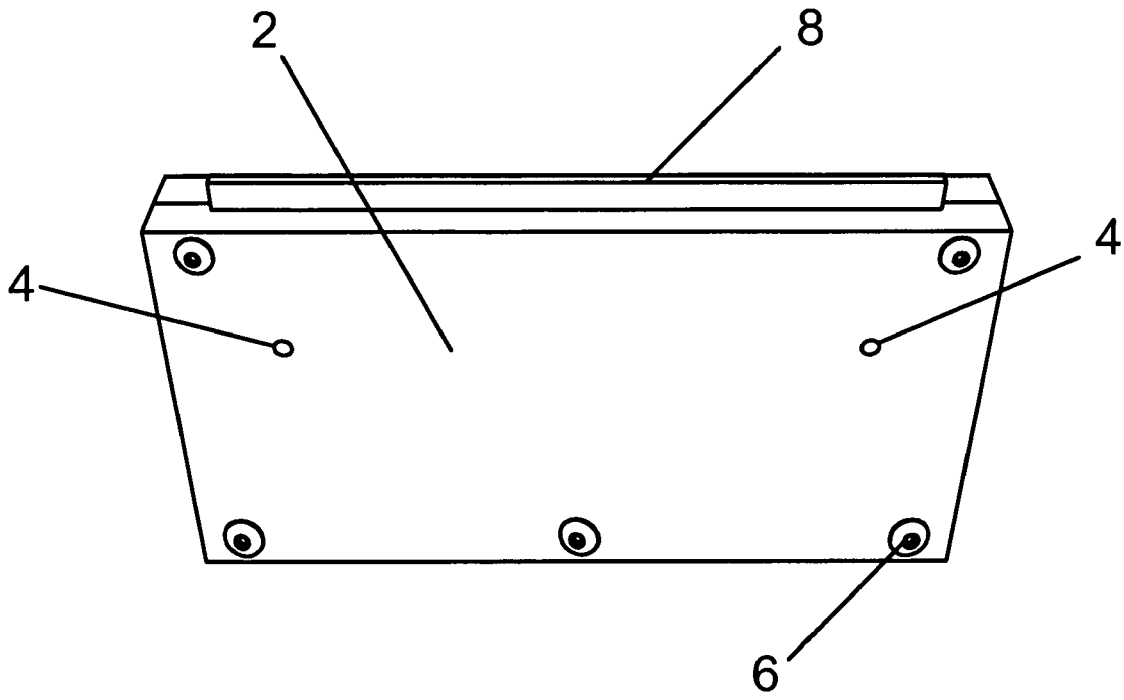
FIG. 2 is a bottom plan view of a wax jig with a sheet of machinable wax placed in the jig.

FIG. 2 shows a bottom plan view of the wax jig 2 with a sheet of machinable wax 8 placed in the jig. Punch bit holes 4 are shown. The purpose of the punch bit holes is to retain and guide wax punches as they are pushed through the sheet of machinable wax 8, creating sprues in the sheet of machinable wax 8 that are used to align the sheet of machinable wax in subsequent machining operations that will be described later in this specification. Wax punches are illustrated in FIG. 4.

Figure 3:
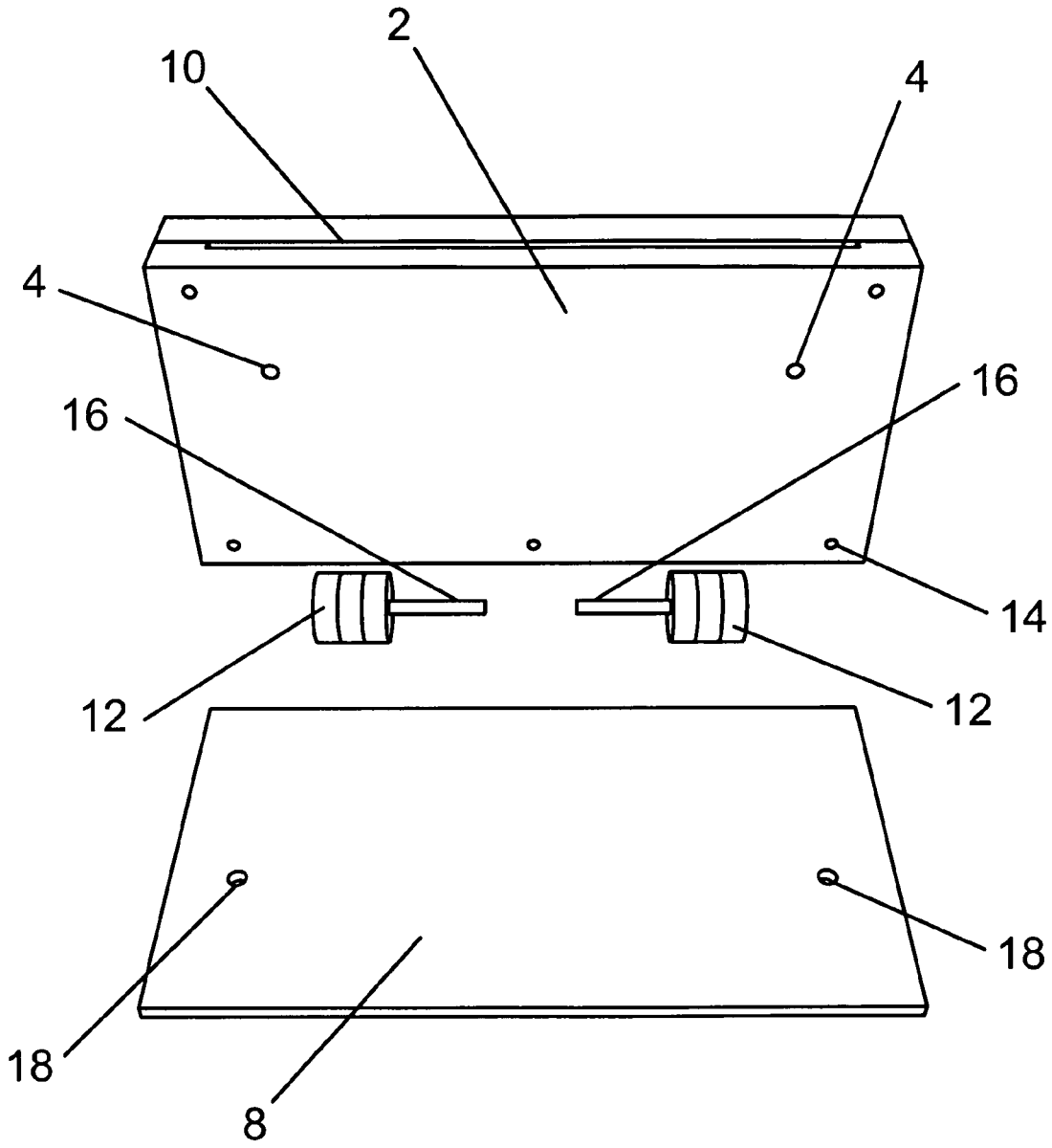
FIG. 3 is a perspective view of a wax jig and a sheet of machinable wax showing wax punches and wax alignment sprues.

FIG. 3 shows a perspective view of a wax jig 2 and a sheet of machinable wax 8 showing the wax punches 12 removed from the punch bit holes 4. The wax punches 12 in some embodiments of the present invention are made of brass and stainless steel, although other metals and plastics would work equally as well. The wax punches 12 contain a sharp wax punch bit 16 that is used to cut alignment sprues 18 in the sheet of machinable wax 8. In use, the sheet of machinable wax 8 is inserted in the wax jig slot 10. The wax punch bits 16 are inserted into the punch bit holes 4 with sufficient force to cut alignment sprues 18 in the sheet of machinable wax 8. The insertion of the wax punch bits 16 into the punch bit holes 4 and through the sheet of machinable wax 8 may be performed by hand, or, in some embodiments of the present invention, the insertion of the wax punch bits 16 into the punch bit holes 4 and through the sheet of machinable wax 8 may be performed with the assistance of a mechanical or electrical device such as a hydraulic cylinder or a solenoid. The primary purpose of the wax jig 2 is to position the alignment sprues 18 and rigidly retain the sheet of machinable wax 8 while the wax punch bits 16 are pushed through the sheet of machinable wax 8.

Figure 4:
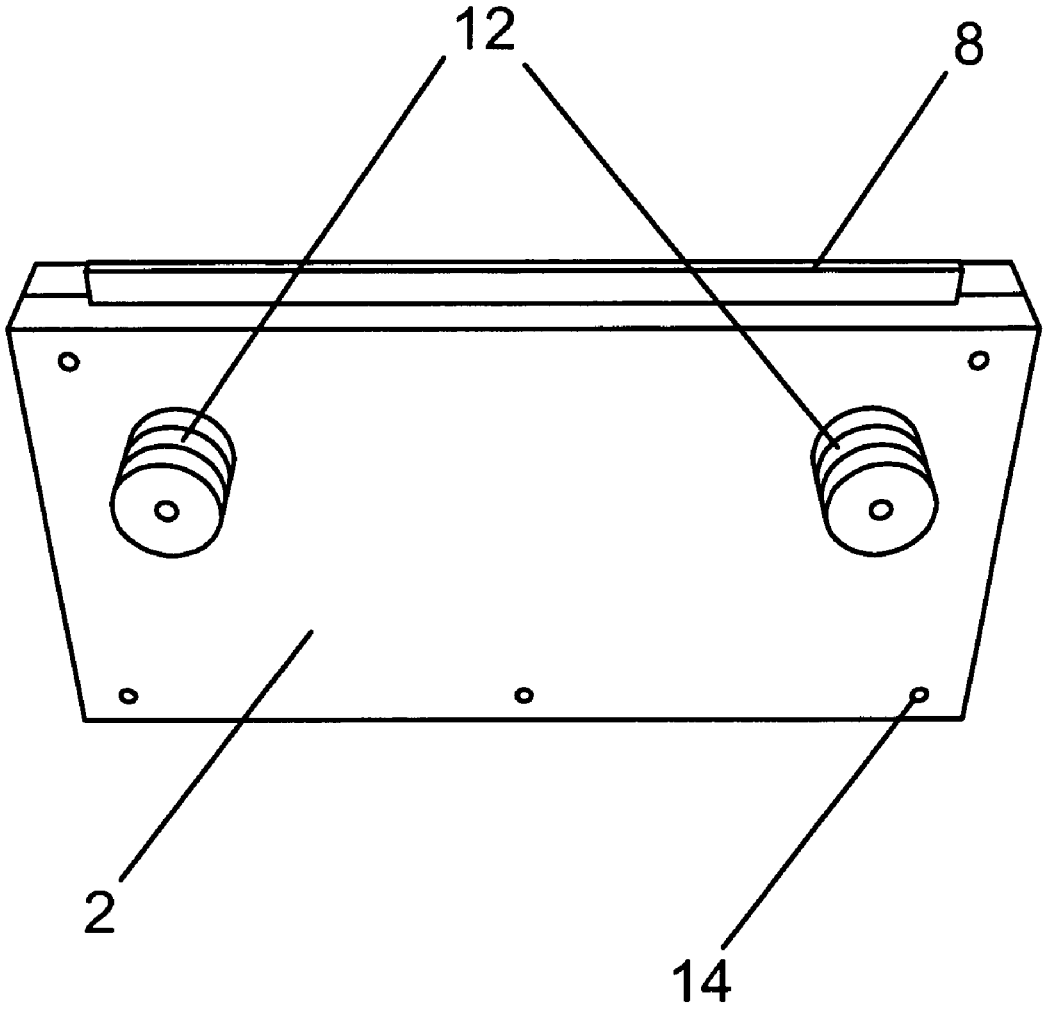
FIG. 4 is a top plan view of a wax jig with a sheet of machinable wax placed in the jig.

Referring now to FIG. 4, a top plan view of a wax jig with a sheet of machinable wax placed in the wax jig is shown. In FIG. 4, wax punches 12 are clearly visible, and are inserted in the punch bit holes 4 that are shown previously in FIGS. 1 and 2. While a sheet of machinable wax is placed in the wax jig 2, the wax punches 12 are pushed through the punch bit holes 4 to cut alignment sprues in the sheet of machinable wax 8 to assist in subsequent machining operations. FIG. 4 also shows holes 14 that are used to assemble the wax jig 2 using hardware such as bolts 6 that are shown previously in FIGS. 1 and 2.

Figure 5:
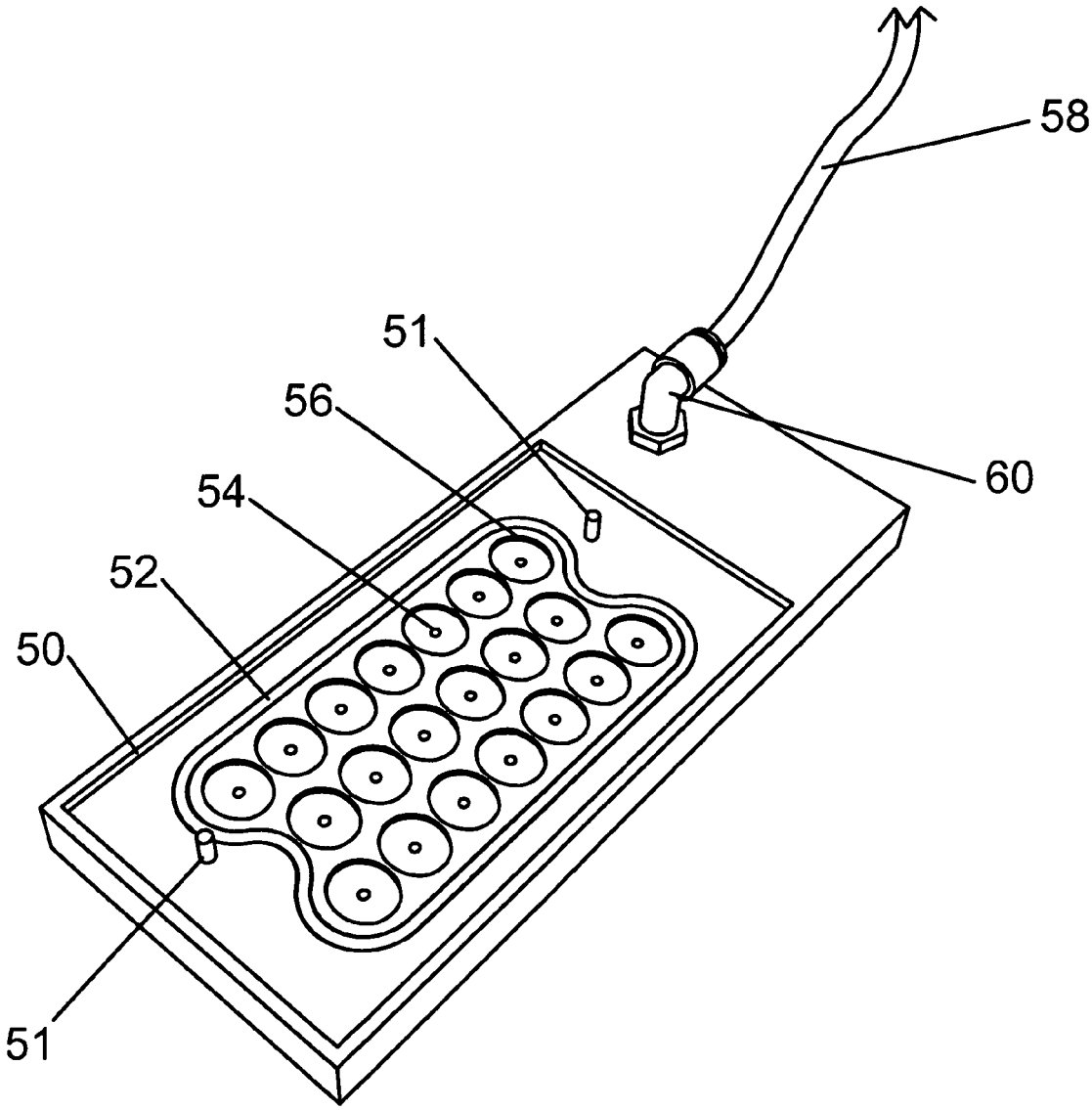
FIG. 5 is a perspective view of a vacuum table.
Figure 6:
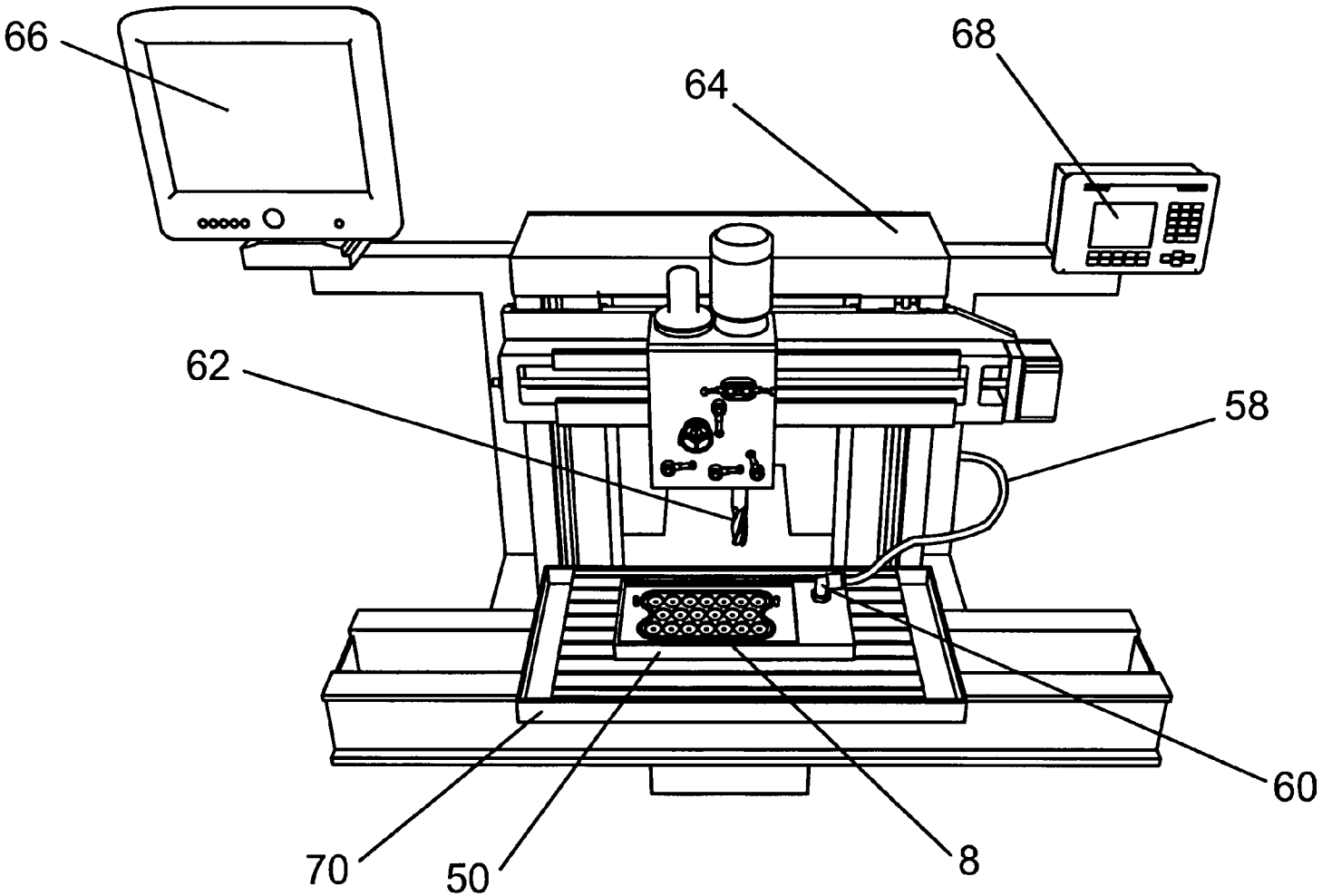
FIG. 6 is a front elevation view of a CNC machine with the vacuum table installed.
Figure 7:
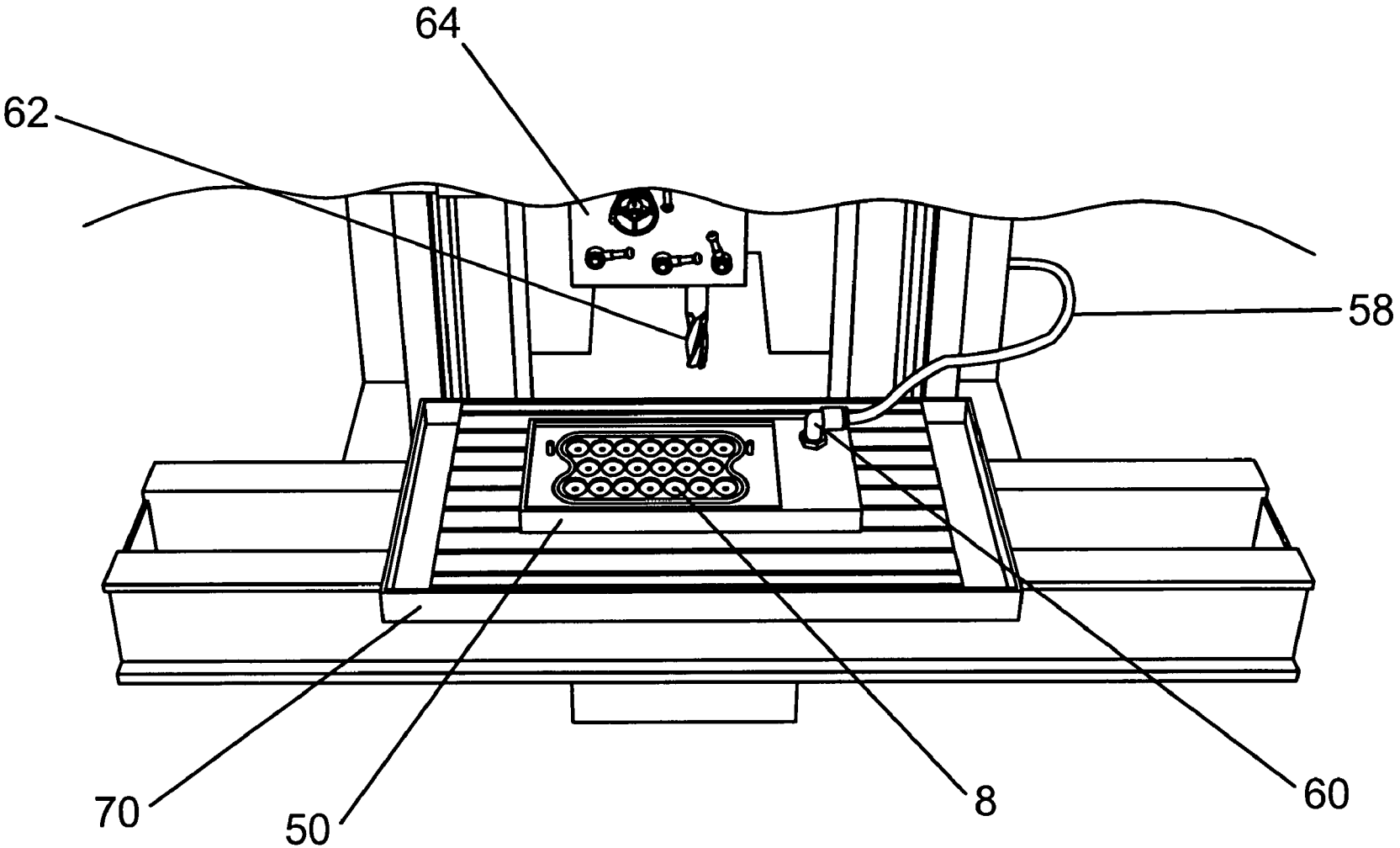
FIG. 7 is another front elevation view of a CNC machine.

In manufacturing the article of jewelry, once the sheet of machinable wax 8 is punched to create alignment sprues 18, the sheet of machinable wax 8 is now ready to be machined and cut as will be further described by way of FIGS. 5, 6, and 7.

Referring now to FIG. 5, a perspective view of a vacuum table is shown. The primary purpose of the vacuum table 50 is to retain the sheet of machinable wax 8 (not shown in FIG. 5, see FIGS. 1,2,3 and 4) while subsequent machining operations are performed, as will be described later in this specification. Using a sheet of machinable wax 8 that has been prepared with alignment sprues 18 as previously described (not shown in FIG. 5, refer to FIG. 3), the sheet of machinable wax 8 (not shown) is placed on the vacuum table 50. The alignment sprues 18 of the prepared sheet of machinable wax 8 (not shown) are placed over the alignment stubs 51, the result of this operation being that the sheet of machinable wax 8 is properly aligned on the vacuum table 50. Proper alignment refers to the correct placement of the sheet of machinable wax with respect to subsequent machining operations that will be described later in this specification. Proper alignment refers to placement of the sheet of machinable wax 8 (not shown) in all three dimensions, including adequate physical contact between the sheet of machinable wax 8 (not shown) and the gasket 52 to provide for a vacuum seal. The vacuum table 50 is supplied with vacuum through a series of channels (not shown) within the vacuum table 50. The series of channels are supplied vacuum through a vacuum line 58 that is connected to the vacuum table 50 with a vacuum connector 60. Each of the channels within the vacuum table 50 terminate at a vacuum hole 54. In some embodiments of the present invention, each vacuum hole 54 may be located below a location on the machinable wax sheet 8 where a wax workpiece will be cut in subsequent machining operations. A wax workpiece is defined as a representative image of an article of jewelry to be used in a lost wax casting operation that is defined later in this specification, and is commonly known to those skilled in the art. In one embodiment of the present invention, there are twenty vacuum holes 54. More or less vacuum holes 54 may be used depending on the quantity of workpieces to be cut from the machinable wax sheet 8. Surrounding each vacuum hole 54 may be an outline 56 of the workpiece to be cut from the machinable wax sheet 8.

FIG. 6 is a front elevation view of a computer-numeric controlled (CNC) machine 64 with the vacuum table 50 installed. The machinable wax sheet 8 is shown in position on the vacuum table 50. The vacuum table 50 is attached to an X-Y table 70. The X-Y table 70 allows for translation and alignment in two dimensions (the X-axis and the Y-axis) in relation to a computer-numeric controlled (CNC) cutter head 62. As is known to those skilled in the art, the computer-numeric controlled (CNC) machine moves a computer-numeric controlled (CNC) cutter head 62 in response to a computer program. The computer-numeric controlled (CNC) cutter head 62 contains a rotating bit (not shown), and moves in all three dimensions in response to control logic contained either within the computer-numeric controlled. (CNC) machine 64 or within an external computer connected to the computer-numeric controlled (CNC) machine 64. A computer monitor 66 may be used to convey information about the machining operation to the operator of the computer-numeric controlled (CNC) machine 64. A positioning readout 68 may also be used to assist with the manufacturing process.

The CNC machine 64 cuts multiple wax workpieces that are used in a subsequent lost wax casting process. To create the wax workpieces, a fingerprint or other image is taken using a technique such as placing the finger on a sheet of carbon paper, removing the finger from the carbon paper, and impressing the finger upon a sheet of paper. The fingerprint or other image is then photographed using a digital camera that is set up to take close range images. Other images may include footprints, handprints, noseprints, and the like. The digital image of the fingerprint or other image is then stored in a digital file format such as a jpeg file format or other file format known to those skilled in the art. The digital file may then be further processed and enhanced on a computer to obtain desired properties such as shading, depth, and the like. The digital file is later converted to a computer language that is used to control a CNC machine, such as G code. This technique eliminates the risk of hot wax burns, creates a direct image (not a mirror image) of the fingerprint or other image, and allows for the creation of multiple wax workpieces and subsequently multiple lost wax castings. The image can also be archived. The backside of the wax workpiece may also contain letters and numbers such as a person's name, date of birth, and the like. The letters and numbers may be cast by creating a digital image of the inscription, storing the digital image in a digital file format such as a jpeg format, and converting the digital file to a computer language that is used to control a CNC machine, such as G code. Other embodiments of the present invention may use laser etching equipment in place of the CNC machine, as would be known to those skilled in the art.

Referring again to FIG. 6, to create the wax workpieces from the machinable wax sheet 8, the machinable wax sheet 8 is installed on the vacuum table 50 using the alignment sprues 18 and the alignment stubs 51. The vacuum is applied through the attached vacuum line 58, and the CNC machine 64 is operated with the appropriate machine control software. The X-Y table 70 moves in accordance with the machine control software to cut one side of the wax workpieces. Once the CNC cutting is complete, the machinable wax sheet 8 is removed from the vacuum table 50, flipped over, and reinstalled on the vacuum table 50 in such a manner as to allow the second side of the wax workpiece to be cut by the CNC cutter head 62. The proper alignment of the machinable wax sheet 8 and subsequent wax workpieces is accomplished through the use of the alignment sprues 18 and the alignment stubs 51 in conjunction with proper operator procedures.

Once the wax workpieces are cut from the machinable wax sheet 8, each machined wax workpiece is invested and cast using the age-old technique of lost wax casting. The casting metal may be gold, silver, platinum, an alloy, or the like. The finished casting may be fabricated into a necklace, bracelet, ring, or other article of jewelry. The article of jewelry may be decorated with faceted stones, cabochons, or other decorative items that are known to those skilled in the art.

FIG. 7 provides another front elevation view of a CNC machine showing in more detail the cutter head 62 and the machinable wax sheet 8 that is in place for machining operations.

Figure 8:
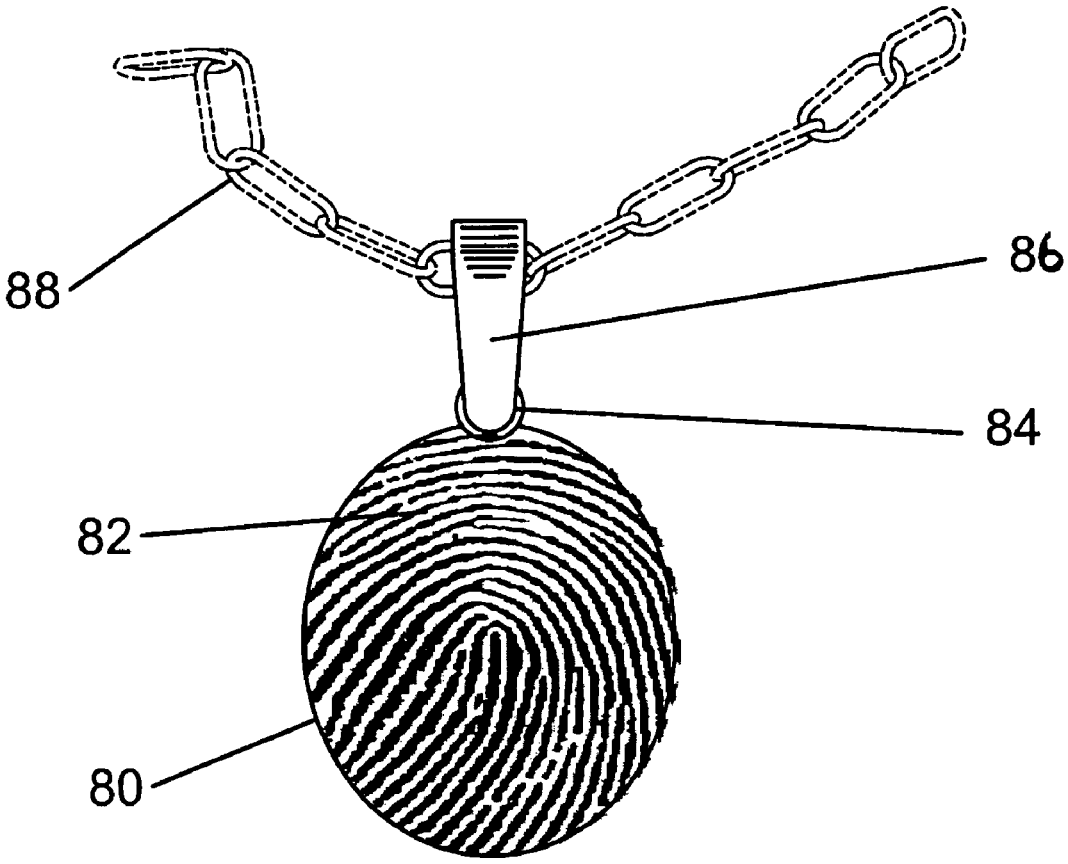
FIG. 8 is a front plan view of an article of jewelry portraying the image of a fingerprint.

Referring now to FIG. 8, a front plan view of an article of jewelry portraying the image of a fingerprint is shown. The article of jewelry is a pendant 80, and was manufactured using an inventive method that is one object of the present invention. The pendant 80 was cast with a fingerprint image 82. Other anatomical images such as, but not limited to, footprints, handprints, noseprints, and the like, may also be used without departing from the spirit and scope of the present invention. The pendant further contains a bail hole 84. The bail hole 84 contains a novel bail 86 that is another object of the present invention, and is shown in more detail in FIG. 13. The bail 86 provides an attachment point for securing the pendant 80 to a chain 88. The bail 86 may further be decorated with faceted stones, cabochons, or other items known to those skilled in the art.

Figure 9:
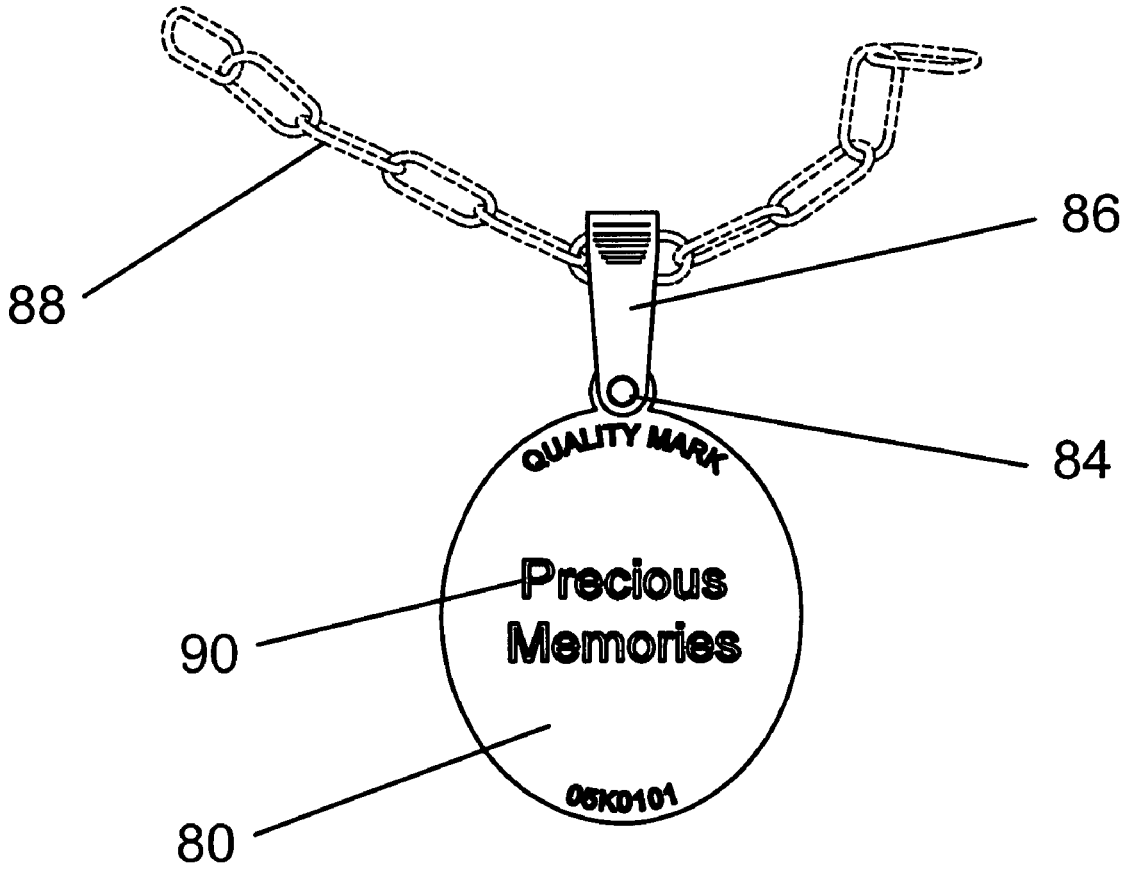
FIG. 9 is a back plan view of an article of jewelry showing a cast inscription.

Referring to FIG. 9, a back plan view of an article of jewelry is shown. The article of jewelry was manufactured using an inventive method that is an object of the present invention. The back plan view of the article of jewelry may, in one embodiment, contain an inscription 90. The inscription 90 may be cast using the lost wax method of casting.

Figure 10:
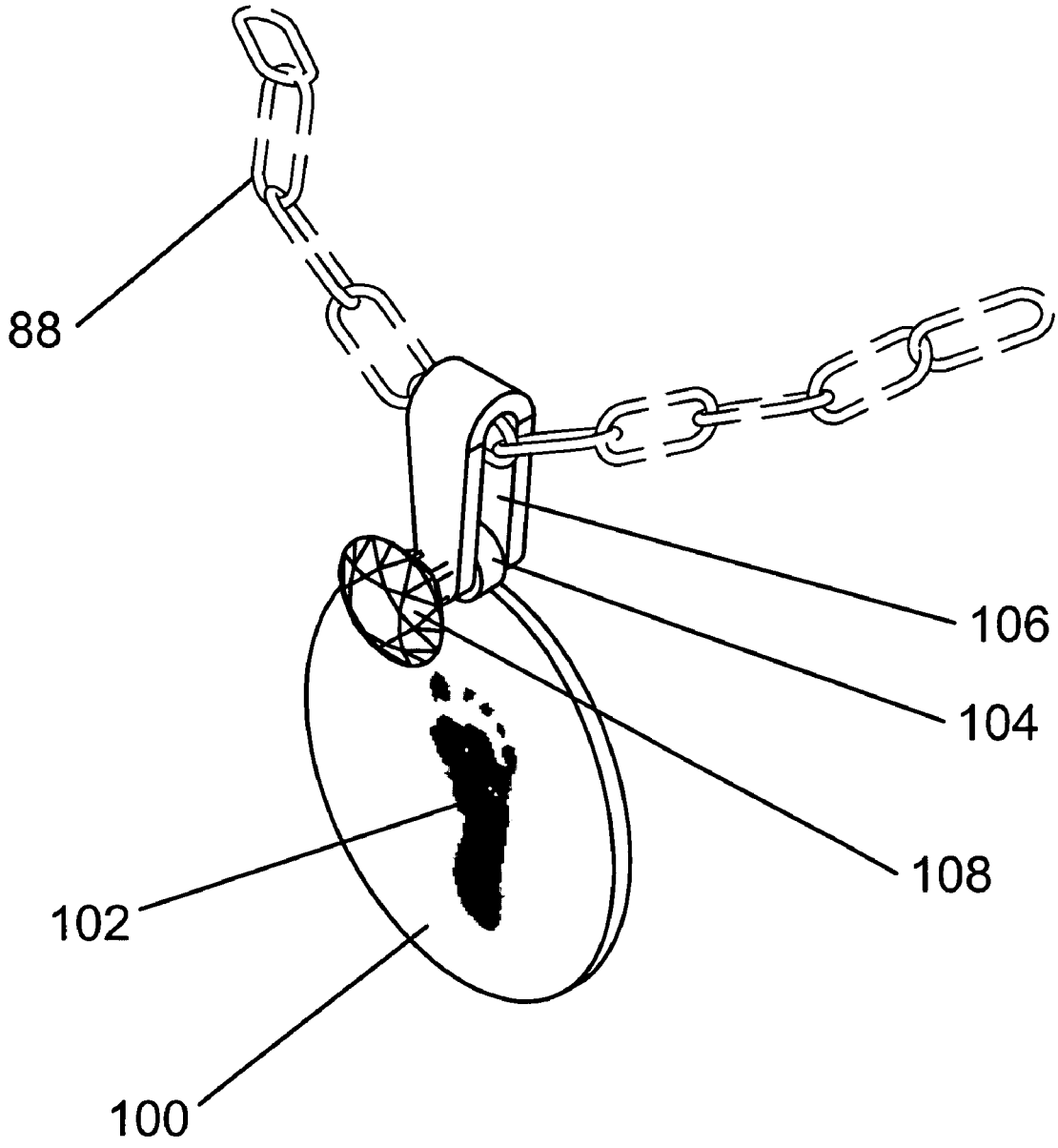
FIG. 10 is a front plan view of an article of jewelry portraying an image of a footprint.

Referring now to FIG. 10, a front plan view of a pendant 100, is shown with an image of a footprint 102. The footprint image 102 was reduced in size using a digital photographic technique, and was manufactured using an inventive method that is an object of the present invention. The pendant 100 was cast with a footprint image 102. The pendant further contains a bail hole 104. The bail hole 104 contains a novel bail 106 that is another object of the present invention, and is shown in more detail in FIG. 13. The bail 106 provides an attachment point for securing the pendant 100 to a chain 88. The bail 106 may further be decorated with a faceted stone setting 108, cabochons, or other items known to those skilled in the art. The back of the pendant 100 may contain an inscription such as shown in FIG. 9.

Figure 11:
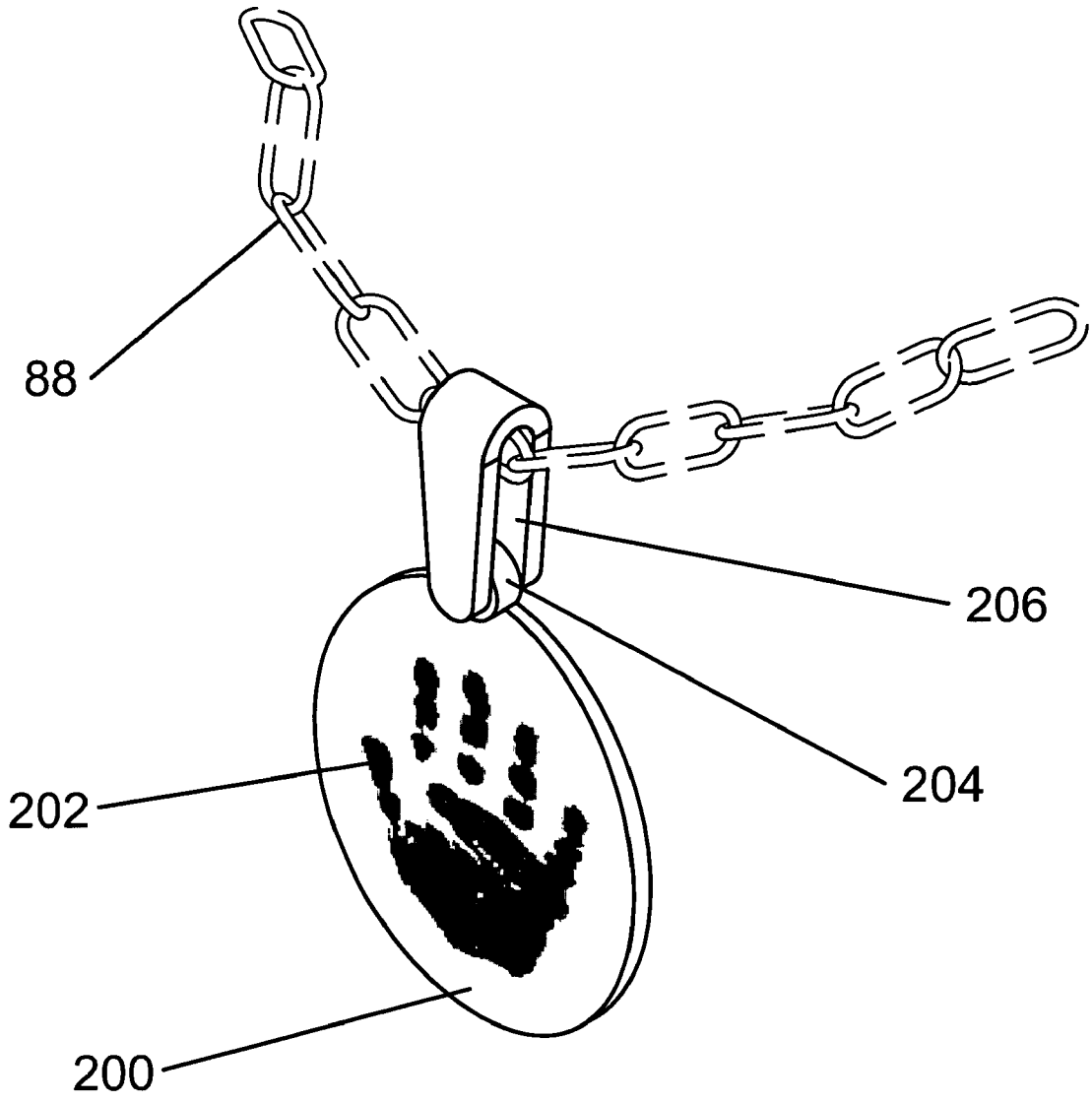
FIG. 11 is a front plan view of an article of jewelry portraying an image of a handprint.

Referring now to FIG. 11, a front plan view of a pendant 200 is shown with an image of a handprint 202. The handprint image 202 was reduced in size using a digital photographic technique, and was manufactured using an inventive method that is an object of the present invention. The pendant 200 was cast with a handprint image 202. The pendant further contains a bail hole 204. The bail hole 204 contains a novel bail 206 that is another object of the present invention, and is shown in more detail in FIG. 13. The bail 206 provides an attachment point for securing the pendant 200 to a chain 88. The bail 206 may further be decorated with a faceted stone, cabochons, or other items known to those skilled in the art. The back of the pendant 200 may contain an inscription such as shown in FIG. 9.

Figure 12:
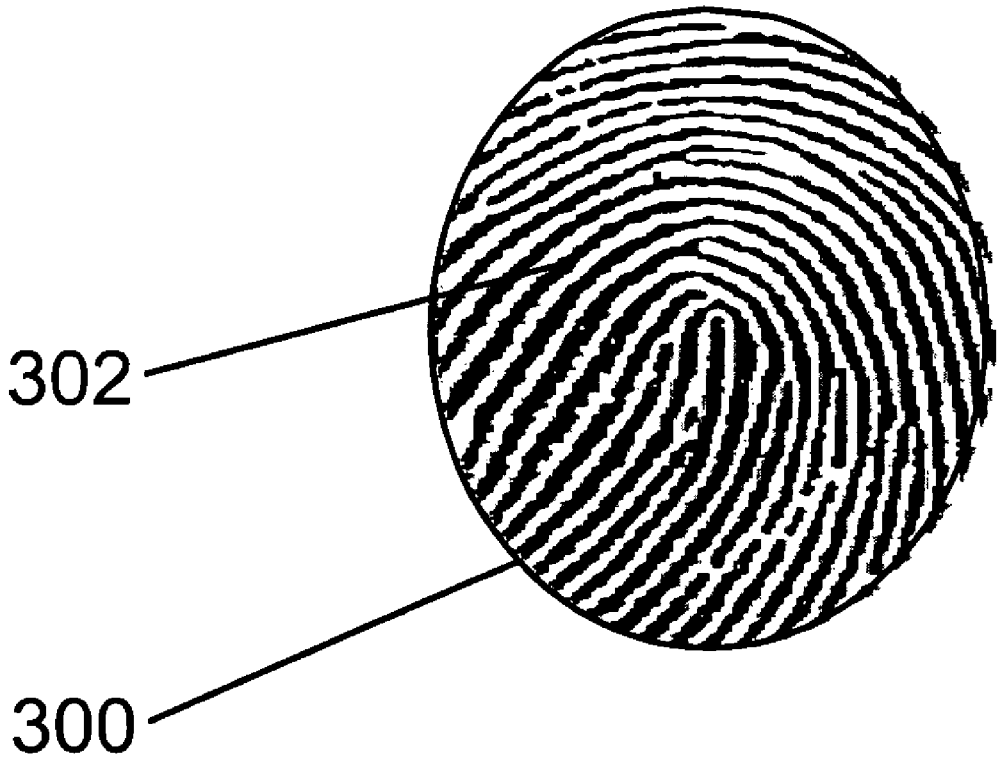
FIG. 12 is a front plan view of a tie tack portraying an image of a fingerprint.

Referring to FIG. 12, a front plan view of a tie tack 300 portraying an image of a fingerprint 302 is shown. The tie tack 300 was manufactured using an inventive method that is an object of the present invention. In other embodiments, the tie tack 300 may portray an image of a footprint, a handprint, or the like.

The pendants 80, 100, and 200 previously described and illustrated in FIGS. 8 and 9, 10, and 11 respectively use a novel bail to attach the cast article of jewelry to a chain. The bail 86, 106, and 206 also illustrated in FIGS. 8 and 9, 10, and 11 respectively are designed to both provide a secure attachment point of the article of jewelry to a chain and to hide the bail hole 84, 104 and 204 as shown in FIGS. 8 and 9, 10, and 11 respectively. The bail holes 84, 104, and 204 detract from the aesthetically pleasing qualities of the article of jewelry.

Figure 13:
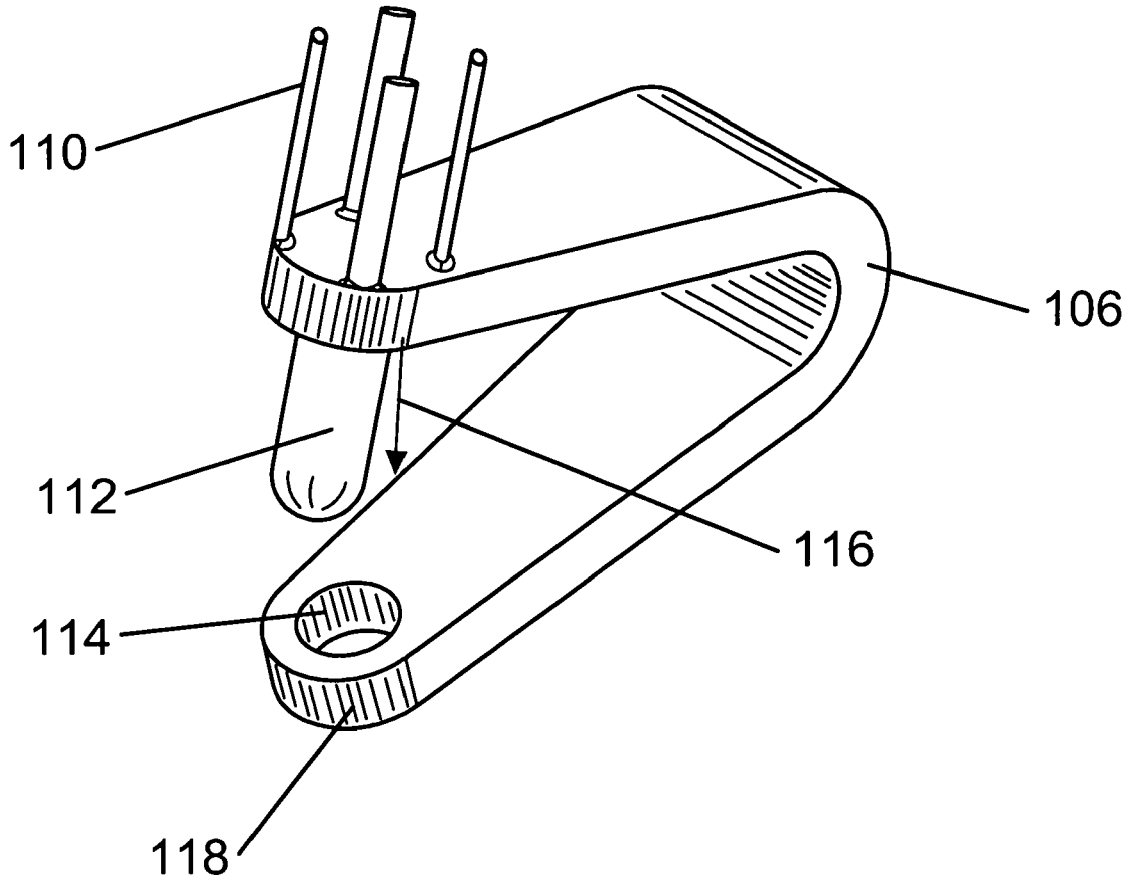
FIG. 13 is a side elevation view of a bail showing a unique pin and socket assembly.

Referring to FIG. 13, a bail 106 is shown. The bail 106 is manufactured using traditional casting techniques for creating jewelry findings that are known to those skilled in the art. In some embodiments of the present invention, the bail 106 may contain a faceted stone setting 110, a cabochon, or other decorative item known to those skilled in the art. The bail 106 contains a pin 112 and a hole 114. To attach the bail 106 to an article of jewelry, the pin 112 is inserted through the bail hole 84, 104 or 204. The bail 106 is then compressed using a jeweler's pliers or similar tool in a direction indicated as 116 in FIG. 13. Once the bail 106 is compressed such that the pin 112 is inserted into the hole 114, a TIG welder, jeweler's soldering torch, laser welder, or the like is used to permanently attach the pin 112 into the hole 114.

Figure 14:
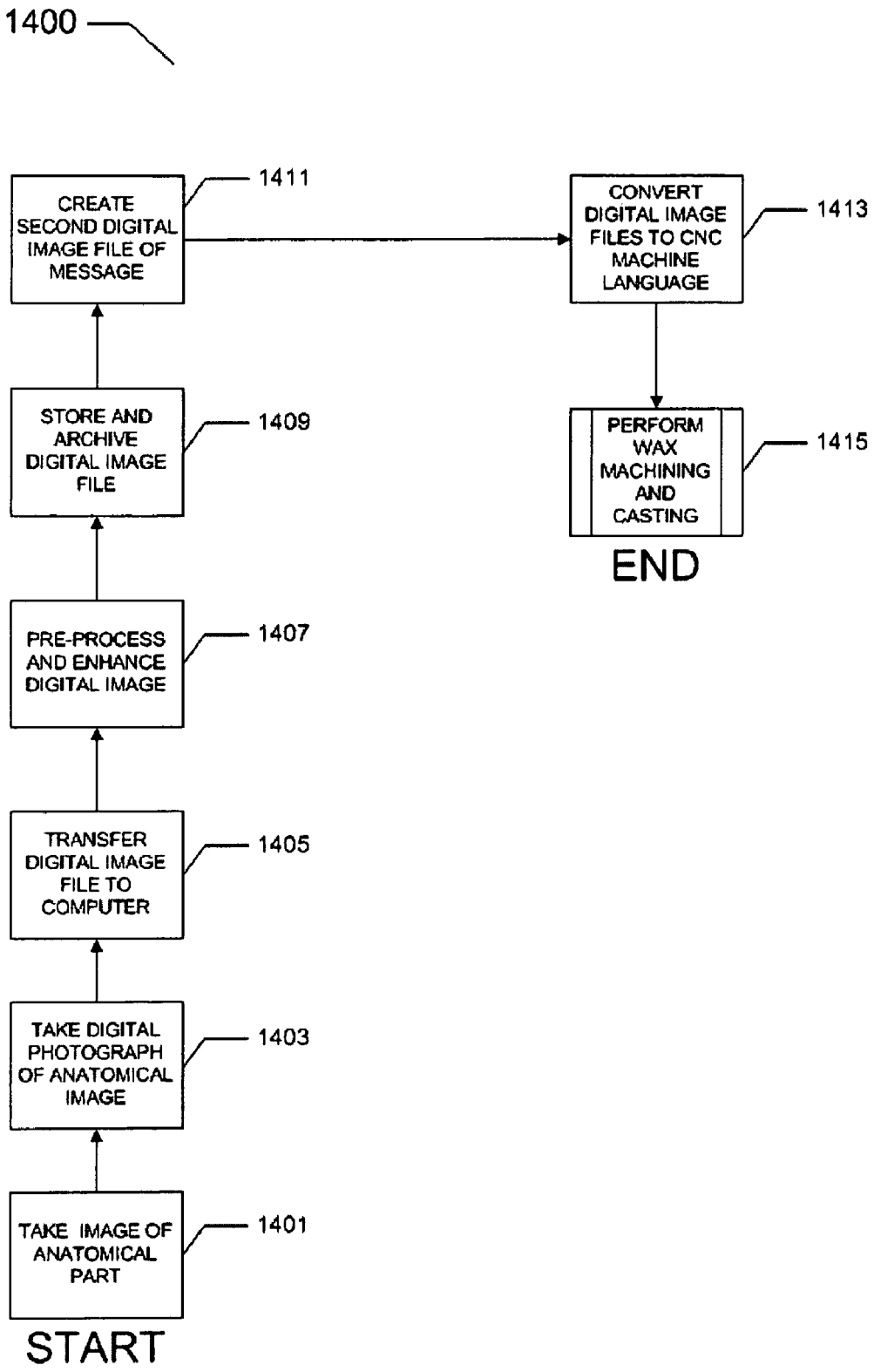
FIG. 14 is a process diagram showing a method of creating CNC machine code used to manufacture an article of jewelry.

Referring now to FIG. 14, a process diagram 1400 showing a method of creating CNC machine code used to manufacture an article of jewelry is shown. In step 1401, an image of an anatomical part is taken using a technique such as that used for taking fingerprints where an inked or inkless pad is used to contact a finger, and the finger is then pressed onto a paper.

The resulting image is that of a fingerprint. Images of footprints may be rendered using similar techniques. Footprints of newborns are often taken in hospitals shortly after birth for identification purposes. The rendered image of the anatomical part from step 1401 is then photographed in step 1403 using a digital camera. The resulting digital image file from step 1403 is then transferred to a computer in step 1405 using techniques commonly known to those skilled in the art. In step 1407, the digital image file of step 1405 may be preprocessed and enhanced using digital photography software to provide improved image quality. In step 1409, the digital image file or files are archived and stored on computer media for future use. In step 1411, a message or an additional image file is created for use on the back side of the resulting article of jewelry. In step 1413, the digital image file or files are converted to computer numeric controlled machine language such as G code using commercially available software conversion programs such as a jpeg to G code converter. In step 1415, wax machining and subsequent casting is performed as described in further detail by way of FIG. 15.

Figure 15:
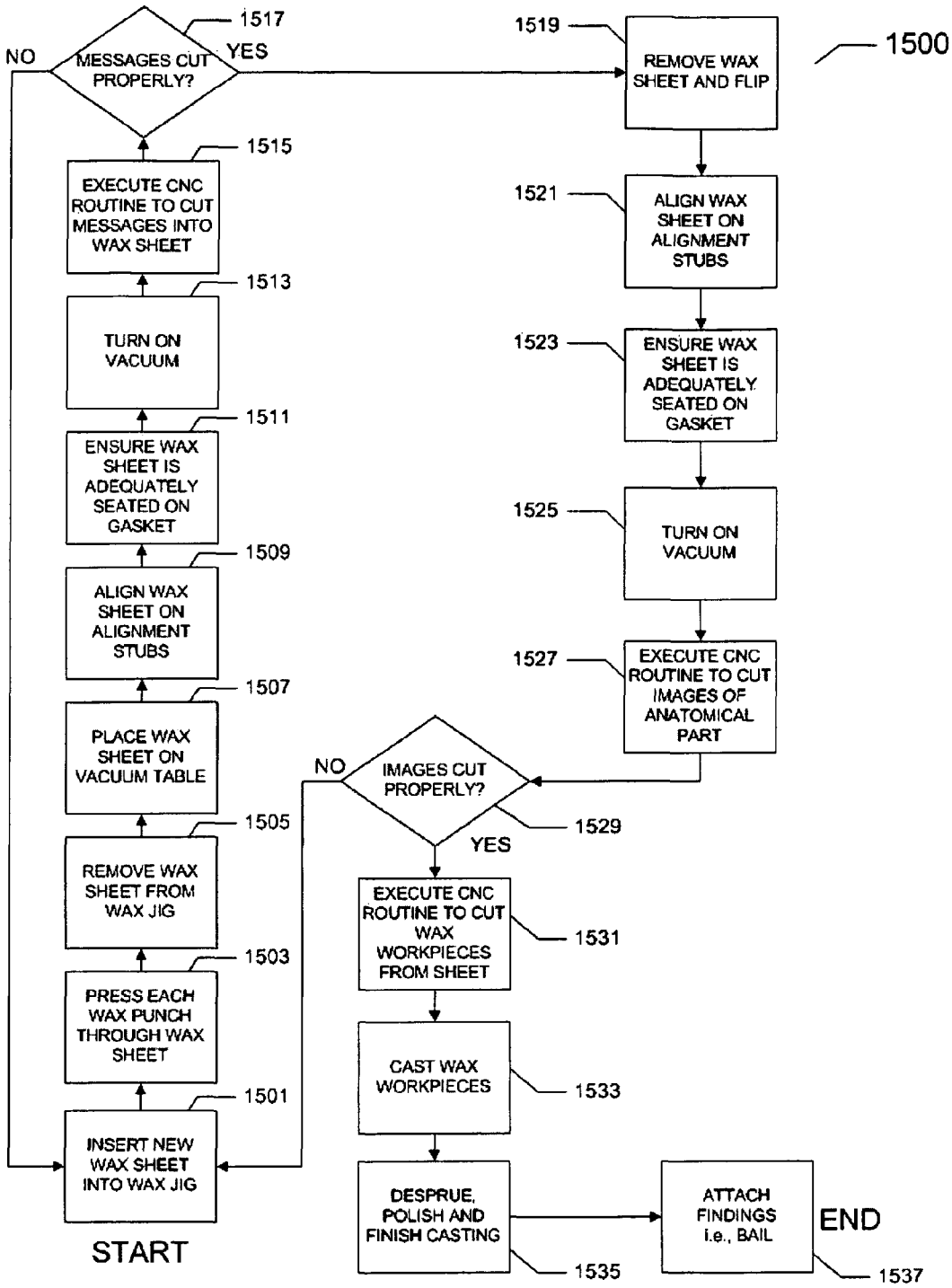
FIG. 15 is a process diagram showing a method of manufacture of an article of jewelry.

Referring now to FIG. 15, a process diagram of a method of manufacture according to one embodiment of the present invention is shown. In step 1501, a machinable wax sheet is inserted into a wax jig. In step 1501, the machinable wax sheet is cut with alignment sprues using a wax punch pushed through holes in the wax jig. In step 1505, the machinable wax sheet is removed from the wax jig. In step 1507, the machinable wax sheet is placed on a vacuum table, and in step 1509 the machinable wax sheet is aligned on the vacuum table. In step 1511, the operator ensures that the wax sheet is adequately seated on a gasket to allow for adequate vacuum on the wax sheet. In step 1513, vacuum is applied to the vacuum table and the wax sheet is firmly retained. In step 1515, a computer numerical controlled routine is executed to cut messages into the wax sheet. In step 1517, an inspection is made to ensure that the messages have been properly cut into the wax sheet. This inspection may be performed manually, or may be performed using imaging or machine vision inspection techniques known to those skilled in the art. If the messages are properly cut into the wax sheet, the wax sheet is removed from the vacuum table in step 1519 and the wax sheet is flipped over to allow for machining on the back side of the wax sheet. If the messages are not properly cut from the wax sheet, the wax sheet is discarded, and a new wax sheet is inserted into the wax jig and the process is started over. Prior to the restart of the process, an operator or other individual may wish to determine why the message was not properly machined in the wax sheet, allowing for necessary corrections to ensure that the message will be properly cut. Upon satisfactory cutting of a message in step 1519, and removal of the wax sheet and flipping of the wax sheet in 1519, the wax sheet is again aligned on the alignment stubs of the vacuum table in step 1521. In step 1523, the operator ensures that the wax sheet is adequately seated on a gasket to allow for vacuum on the wax sheet that is sufficient to retain the wax sheet during machining operations. In step 1525, vacuum is applied to the vacuum table and the wax sheet is firmly retained. In step 1527, a computer numerical controlled routine is executed to cut images of an anatomical part into the wax sheet. In step 1529, an inspection is made to ensure that the images of an anatomical part have been properly cut into the wax sheet. This inspection may be performed manually, or may be performed using imaging or machine vision inspection techniques known to those skilled in the art. If the images of an anatomical part are properly cut into the wax sheet, in step 1531 a computer numeric controlled routine is executed to cut wax workpieces from the wax sheet. In step 1533, the wax workpieces are cast using techniques known to those skilled in the art. In step 1535, the castings are desprued, polished and finished. Lastly, in step 1537, findings are attached to the finished casting. Findings may include rings, bails, posts, prongs, gemstones, semi-precious stones, cabochons, chains, links, bezels, and the like. In one preferred method of the present invention, findings include the novel bail 106 illustrated in FIG. 13.

It is, therefore, apparent that there has been provided, in accordance with the various objects of the present invention, an article of jewelry and a method of manufacturing an article of jewelry. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for creating an article of jewelry that contains an anatomical image, the method comprising the steps of:

a.) taking a print of an anatomical part;

b.) creating a two dimensional digital image file by digitally photographing the print of an anatomical part;

c.) converting the two dimensional digital image file to a computer numeric control machine language program;

d.) loading the computer numeric control machine language program on a computer numeric control machine;

e.) placing a sheet of machinable wax proximate the computer numeric control machine;

f.) executing the computer numeric control machine language program on the computer numeric control machine;

g.) cutting a plurality of positive image wax models of anatomical images in the sheet of machinable wax using the computer numeric control machine;

h.) removing each positive image wax model from the sheet of machinable wax;

i.) creating a mould from each positive image wax model;

j.) using each mould to create a casting from each positive image wax model; and k.) attaching a finding to each casting.

2. The method for creating an article of jewelry that contains an anatomical image as recited in claim 1 wherein the method further comprises the step of despruing, polishing and finishing the casting of the anatomical image.

3. The method for creating an article of jewelry that contains an anatomical image as recited in claim 1 wherein the anatomical image is a fingerprint.

4. The method for creating an article of jewelry that contains an anatomical image as recited in claim 1 wherein the anatomical image is a footprint.

5. The method for creating an article of jewelry that contains an anatomical image as recited in claim 1 wherein the anatomical image is a handprint.

6. The method for creating an article of jewelry that contains an anatomical image as recited in claim 1 wherein the anatomical image is a noseprint.

* * * * *